United States Patent [19]

Sepavich

[11] 4,207,926

[45] Jun. 17, 1980

[54] LOOM PROJECTILE

[75] Inventor: Victor F. Sepavich, West Boylston, Mass.

[73] Assignee: Crompton & Knowles Corporation, New York, N.Y.

[21] Appl. No.: 19,696

[22] Filed: Mar. 12, 1979

[51] Int. Cl.[2] ..... D03J 5/06

[52] U.S. Cl. ..... 139/196.3

[58] Field of Search ..... 139/196.1, 196.2, 196.3, 139/437, 438, 439, 436

[56] References Cited

U.S. PATENT DOCUMENTS

| | | | |
|---|---|---|---|
| 3,831,640 | 8/1974 | Wueger | 139/196.3 |
| 3,902,530 | 9/1975 | Wueger | 139/196.3 |
| 4,095,620 | 6/1978 | Sepavich et al. | 139/196.3 |

FOREIGN PATENT DOCUMENTS

| | | | |
|---|---|---|---|
| 223143 | 8/1962 | Fed. Rep. of Germany | 139/436 |
| 82678 | 6/1971 | Fed. Rep. of Germany | 139/196.3 |
| 2254974 | 7/1974 | Fed. Rep. of Germany | 139/196.3 |
| 2823131 | 11/1978 | Fed. Rep. of Germany | 139/196.3 |
| 1033060 | 6/1966 | United Kingdom | 139/439 |
| 1081404 | 8/1967 | United Kingdom | 139/196.3 |
| 1098802 | 1/1968 | United Kingdom | 139/439 |

*Primary Examiner*—Henry Jaudon

[57] ABSTRACT

A projectile for use in a loom in which filling picks are inserted into a warp shed from an outside supply source comprising an elongated body having an inlet opening at one of its ends and an outlet opening at the opposite end thereof. Inside of the body there is an elongated cavity which extends along the longitudinal axis of the body. This cavity is divided into two (2) filling storage chambers by a perforated partition which extends across the longitudinal axis at an angle of less than 90 degrees thereirom. The inlet opening for one of these chambers constitutes the outlet opening for the other chamber, for the air flow which is used to deposit filling yarn into the chambers of the projectile.

6 Claims, 4 Drawing Figures

LOOM PROJECTILE

BACKGROUND OF THE INVENTION

This invention relates generally to a projectile for the insertion of filling yarn into the warp shed of a loom wherein the filling yarn is supplied from a supply package located outside of the warp shed. The present invention is particularly directed to a projectile of the type in which at least a portion of a pick of the filling yarn is stored in a filling storage chamber within the projectile, and withdrawn therefrom during the projectile flight through the warp shed. This type of projectile and the loom in which it is used is shown in U.S. Pat. No. 3,831,640, issued to Karl W. Wueger, on Aug. 27, 1974. In the loom of this U.S. Patent, at least a portion of a pick of the filling is inserted into the projectile by means of an air flow which passes into one filling chamber and out of the other chamber, depositing yarn into the first filling chamber, prior to launching the projectile through the warp shed for inserting filling therein.

This invention is particularly directed to the class of projectiles in which at least a portion of the filling pick is inserted into the projectile by use of air currents. Projectiles of this type are designed to permit air to flow through the storage chamber from an inlet opening and to allow the filling yarn, entering through the inlet opening, to be carried by the air flow and be deposited within the chamber. The manner in which the filling is deposited in the chamber is critical for the withdrawal of the filling as the projectile passes through the warp shed. If the filling is deposited in a random, haphazard manner, snarls are likely to occur as the filling is withdrawn. In addition, it is important that the filling be withdrawn smoothly and evenly.

Another problem sometimes encountered is that the means which permits the air to flow through the chamber for depositing filling within the chamber also causes a reverse air flow during the projectile flight, thus causing the filling yarn stored in the chamber to be sometimes blown out of the trailing end of the projectile prematurely and thereby to deposit the filling in a bunch or snarl within the warp shed. This produces a defective pick and defective fabric.

Occasionally, difficulties have been encountered in loading the filling into the projectile. As the filling is deposited in the storage chamber it tends to settle against the outlet openings of the chamber and to block these openings thereby reducing the air flow through the projectile and interfering with the proper deposit of additional filling yarn into the projectile.

Many of the problems stated above have been overcome by the projectile developed by my co-worker, Petras Cyvas, and disclosed in U.S. patent application Ser. No. 960,344, filed Nov. 13, 1978, for "LOOM PROJECTILE". The projectile in this application has either one or two flat storage chambers located within a cylindrical body. A disadvantage of this type of projectile is that the storage chamber carrying filling is located completely on one side of the center of gravity of the projectile; therefore, the yarn causes an imbalance in the projectile.

Another disadvantage of this type of projectile is that the storage chambers utilize only a small portion of the entire cylindrical body cavity with a substantial amount of dead space between the inner wall of the cylindrical body and the outer walls of the storage chamber. This means that a projectile of a given diameter can carry less filling yarn than one of the structure of the instant invention.

Another disadvantage of the projectile disclosed in the above identified application, at least in the two-chamber version, is that the air currents carrying the yarn generally must change their direction of flow substantially 90 degrees in order to exit from the chamber after depositing the yarn therein.

It is a principal object of the present invention to provide a loom projectile which includes two filling storage chambers which extend across the center of gravity of the projectile in each instance and in which filling is deposited in a manner which permits the filling to be withdrawn evenly and smoothly from the projectile without causing snarls or twists therein.

Another object of the invention is the provision of a projectile for inserting filling into the warp shed of a loom in which the stored filling is evenly deposited within the projectile and which will not be blown out of the projectile prematurely by air currents passing through the projectile during the projectile's flight.

A further object of the present invention is the provision of a projectile for carrying filling to the warp shed of a loom which utilizes substantially the entire interior cavity of the projectile for storing filling yarn and which offers little or no interference to air currents flowing through the projectile, but does not let the filling be blown out prematurely thereby.

SUMMARY OF THE INVENTION

In general the projectile of the invention comprises an elongated body having an elongated cavity therein, extending along the longitudinal axis of the elongated body. The elongated cavity is divided into two separate filling storage chambers by means of a perforated partition which extends across the elongated cavity diagonally of the longitudinal axis of said cavity. At each end of the elongated body a yarn opening is provided wherein a filling insertion nozzle can enter for depositing the filling within the storage chamber. The perforated partition provides a flat surface on which the yarn is deposited in a series of flat elongated loops that are confined by the interior walls of the elongated cavity.

BRIEF DESCRIPTION OF THE DRAWINGS

The character of the invention, however, may be best understood by reference to one of its structural forms as illustrated by the accompanying drawings in which.

DETAILED DESCRIPTION OF THE INVENTION

Figure 1:
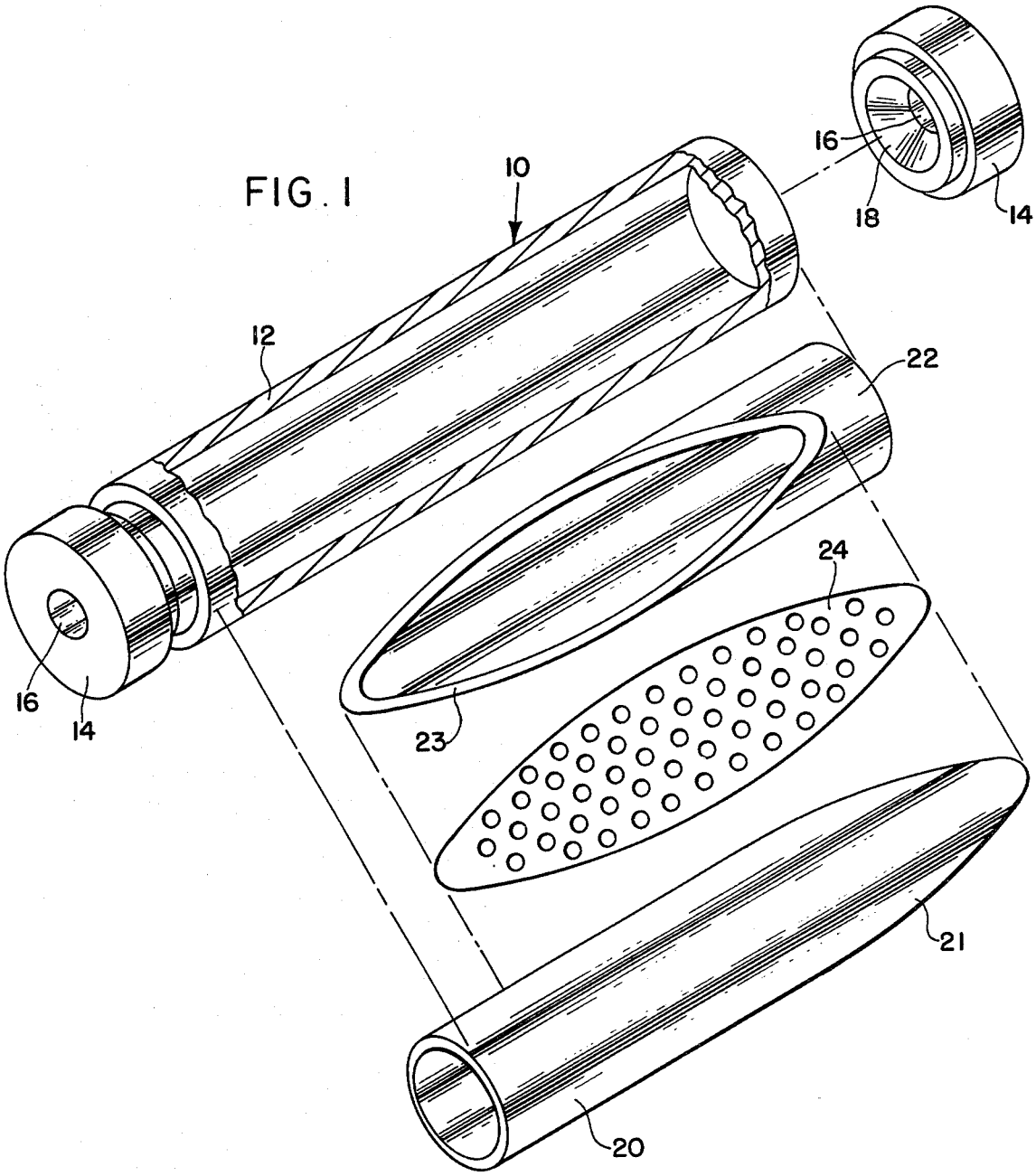
FIG. 1 is an exploded perspective view showing all of the elements of the projectile of the invention.
Figure 2:
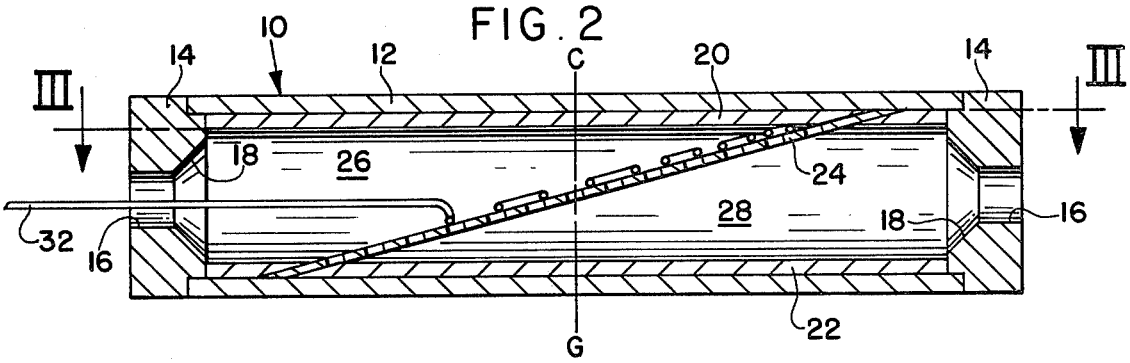
FIG. 2 is a vertical cross-sectional view of the projectile illustrated in FIG. 1.
Figure 3:
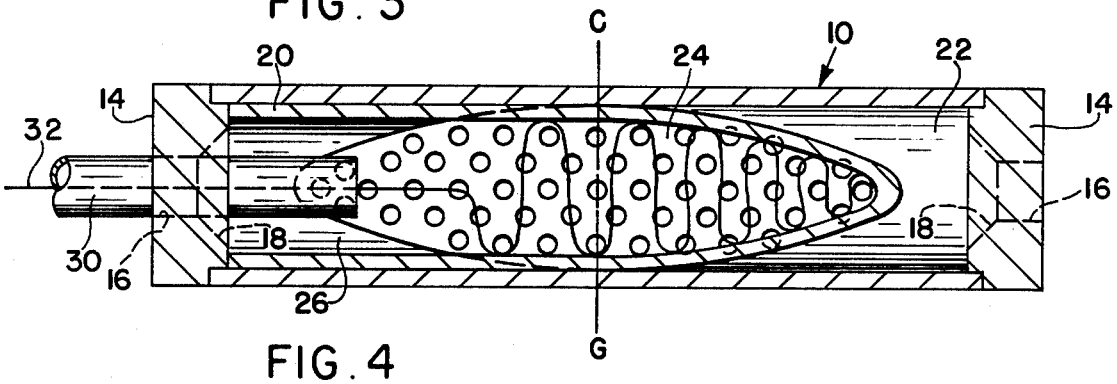
FIG. 3 is a horizontal sectional view taken along line III—III of FIG. 2.

The drawings appended hereto illustrate a projectile made in accordance with the principles of the present invention. The projectile shown in FIGS. 1 through 3 represent the preferred embodiment of the invention and FIG. 4 discloses an alternative embodiment of the invention. The projectile shown in all of these drawings is designed for use in a loom wherein the projectile is picked from opposite ends of the loom, alternately, and the projectile is, therefore, symmetrical in every respect.

Referring more particularly to FIGS. 1 through 3, the projectile is generally indicated by the reference number 10 and comprises a hollow, elongated cylindrical body having an outer shell 12. At each end of the outer shell 12 there are fixed end caps 14 which, together with the outer shell, comprises the outer part of the elongated body for the projectile.

Each end cap 14 is provided with an opening 16 which has a tapered portion 18. The purpose of opening 16 is to permit access to the interior portion of the outer shell 12. End caps 14 are bonded or otherwise attached to the ends of outer shell 12 to provide the outer surfaces of the elongated body. Inside of shell 12, and confined by shell 12 and end caps 14, are first and second inner shell halves 20 and 22 as seen in FIG. 1. These shells are tubular and their inner ends 21 and 23 terminate in an elongated oval opening which bisects the longitudinal axis of the inner shells at the diagonal. As assembled, the inner ends 21 and 23 of the first and second inner shells are separated by a perforated plate 24 which matches the openings at ends 21 and 23. Plate 24 is bonded or otherwise secured to ends 21 and 23, forming an elongated cavity within the interior of the elongated body, which is divided into two storage chambers 26 and 28 by perforated partition 24.

FIG. 3 is a horizontal cross-sectional view of the projectile shown in FIGS. 1 and 2 and also shows how filling 32 is deposited within the filling storage chambers by means of an air nozzle 30. Line C-G, as seen in FIGS. 2 and 3, represents the center of gravity of the projectile so that it can readily be seen that the filling 32, deposited within the storage chamber, is deposited on both sides of the center of gravity and thereby lends greater stability to the projectile during flight.

The operation of the apparatus will be readily understood in view of the above description as seen in FIGS. 2 and 3. It is assumed that the projectile is located at the lefthand side of the loom prior to being launched to the righthand side. Filling yarn 32 is introduced into the lefthand filling chamber 26 by means of an air nozzle 30. Nozzle 30 forms a part of the weft insertion apparatus of the loom and is not a part of the present invention. Prior to insertion into the projectile, filling 32 is severed and partially withdrawn into nozzle 30. Nozzle 30 is inserted into the projectile for the loading sequence and air carries filling 32 into storage chamber 26. The air carrying the filling 32 deposits the filling 32 on the surface of perforated partition 24 in the form of elongated loops that are confined by the interior walls of the elongated cavity forming storage chamber 26. The air carrying the filling passes through perforated partition 24 and out opening 16 which serves as an outlet for the air when the yarn is being deposited in the storage chamber at the opposite end. The perforations in perforated partition 24 are at an angle to the longitudinal axis of the projectile sufficient to prevent the filling from being blown through the perforations but at an angle that is less than 90 degrees to the longitudinal axis so as to reduce the change in direction the air must make in order to escape from the filling storage chamber being loaded. When the projectile is launched through the warp shed it enters the launching and receiving apparatus on the opposite side of the loom and filling is loaded into chamber 28 in precisely the same manner as described herein with regard to chamber 26.

As the projectile passes through the warp shed during its flight from one side of the loom to the other, filling yarn 32 is withdrawn evenly and smoothly from the projectile and avoids the formation of entanglements or snarls. Furthermore, the filling yarn 32 is not deposited over the entire surface of perforated partition 24 as seen in FIG. 2. Therefore, air entering the front end opening 16 of the projectile during flight passes through chamber 28 and through the portion of perforated partition 24 which is not loaded or covered with yarn and out the trailing opening 16 without disturbing the placement of the filling yarn within the projectile. This provides for an even smooth withdrawal of the filling yarn from the storage chamber which enables the filling to be deposited within the warp shed evenly and without snarls or tangles.

The insertion of filling in the warp shed represents a critical phase of the weaving operation and the improvement in this phase provided by the projectile of the present invention contributes greatly to the quality of the cloth produced by the loom.

FIRST MODIFICATION OF THE PROJECTILE

Figure 4:
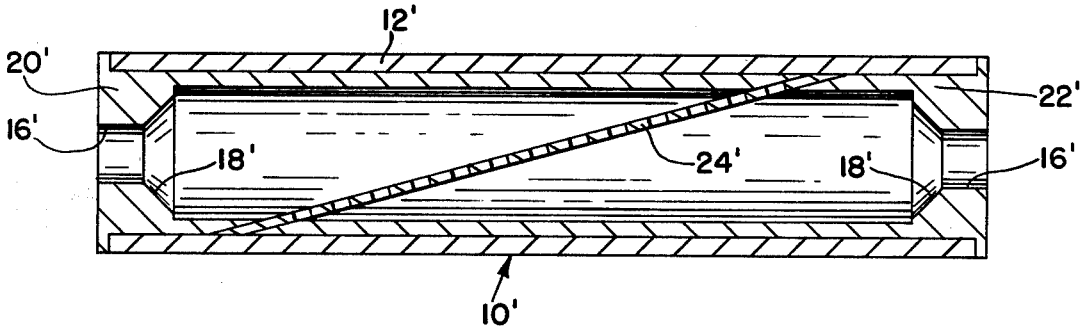
FIG. 4 is a vertical sectional view similar to FIG. 2 of an alternative embodiment of the projectile of the invention.

Referring now to FIG. 4, it will be seen that in this embodiment the functional features of the projectile are identical to those of FIGS. 1 through 3. Like parts in FIG. 4 are identified by the same reference characters as those of FIGS. 1 through 3. However, these reference characters have had primes added thereto to avoid any confusion between the parts of this projectile and those disclosed in FIGS. 1 through 3.

In the embodiment shown in FIG. 4 the end caps have been combined with the inner shell halves forming the elongated cavity. This reduces the number of parts and permits better bonding and securing of the end caps 20' and 22' to outer shell 12' since the outer surfaces of the inner shells can be bonded throughout their length to the interior surfaces of the outer shell thereby securely holding the end caps in place. Other than the change noted herein, the projectile in FIG. 4 is identical to that disclosed in FIGS. 1 through 3. The operation of the modified embodiment of the projectile is identical to that described with reference to FIGS. 1 through 3 and the operation will not be repeated herein.

The elongated cavity as illustrated in the drawings is shown to be cylindrical in configuration. It is obvious that this cavity could have other shapes. For example, the cross-sectional shape could be square or rectangular or even octagonal without departing from the spirit and scope of this invention. It is not desired to confine the invention to the exact form shown and described herein. It is intended that this invention will include all constructions such as properly come within the scope of the claims appended hereto.

I claim:

1. A projectile for use in a loom in which filling picks are inserted into a warp shed from an outside supply source, comprising:

(a) an elongated body having an inlet opening at one of its ends and an outlet opening at the opposite end thereof;

(b) an elongated cavity within said body extending along a longitudinal axis;

(c) a perforated partition located within said cavity, which divides said cavity into two filling storage chambers and extends across said cavity at an angle of less than 90 degrees from the longitudinal axis of said cavity.

2. The projectile as set forth in claim 1, wherein said body is cylindrical.

3. The projectile as set forth in claim 1, wherein the cavity is defined by the inner walls of cylindrical tubular member.

4. The projectile as set forth in claim 3 wherein the perforated partition extends from a point adjacent to the inlet end of said body across the longitudinal axis of said cavity to a point adjacent the outlet end of said body.

5. The projectile as set forth in claims 1 or 4 wherein the partition is substantially flat.

6. The projectile as set forth in claim 3 wherein the partition is substantially flat, elliptical in shape and its circumference is in contact with said inner walls.

* * * * *